United States Patent [19]

Simon

[11] Patent Number: 4,512,400

[45] Date of Patent: Apr. 23, 1985

[54] MISCIBLE DISPLACEMENT DRIVE FOR ENHANCED OIL RECOVERY IN LOW PRESSURE RESERVOIRS

[75] Inventor: Ralph Simon, Placentia, Calif.

[73] Assignee: Chevron Research Company, San Francisco, Calif.

[21] Appl. No.: 545,718

[22] Filed: Oct. 26, 1983

[51] Int. Cl.[3] ..... E21B 43/30; E21B 43/40

[52] U.S. Cl. ..... 166/245; 166/266; 166/274

[58] Field of Search ..... 166/245, 263, 266, 267, 166/273, 274

[56] References Cited

U.S. PATENT DOCUMENTS

| | | | |
|---|---|---|---|
| 2,324,172 | 7/1943 | Parkhurst | 166/266 |
| 2,798,556 | 7/1957 | Binder, Jr. et al. | 166/245 |
| 2,924,276 | 2/1960 | Heilman et al. | 166/266 X |
| 2,994,373 | 8/1961 | Stone | 166/245 |
| 3,137,344 | 6/1964 | Wiemer | 166/266 X |
| 3,256,933 | 6/1966 | Murphree | 166/266 |
| 3,354,953 | 11/1967 | Morse | 166/266 |

*Primary Examiner*—George A. Suchfield

*Attorney, Agent, or Firm*—S. R. LaPaglia; E. J. Keeling; A. Stephen Zavell

[57] ABSTRACT

A process of utilizing natural gas to obtain a miscible drive fluid for low pressure reservoirs is described. The process involves upgrading natural gas to ethane, propane and butane constituents which are fabricated into a mixture which is miscible at the reservoir conditions. The process is operated so as to maximize the reuse of the upgraded miscible drive fluid and therefore lower the cost of enhancing the oil recovery from a low pressure reservoir.

6 Claims, 1 Drawing Figure

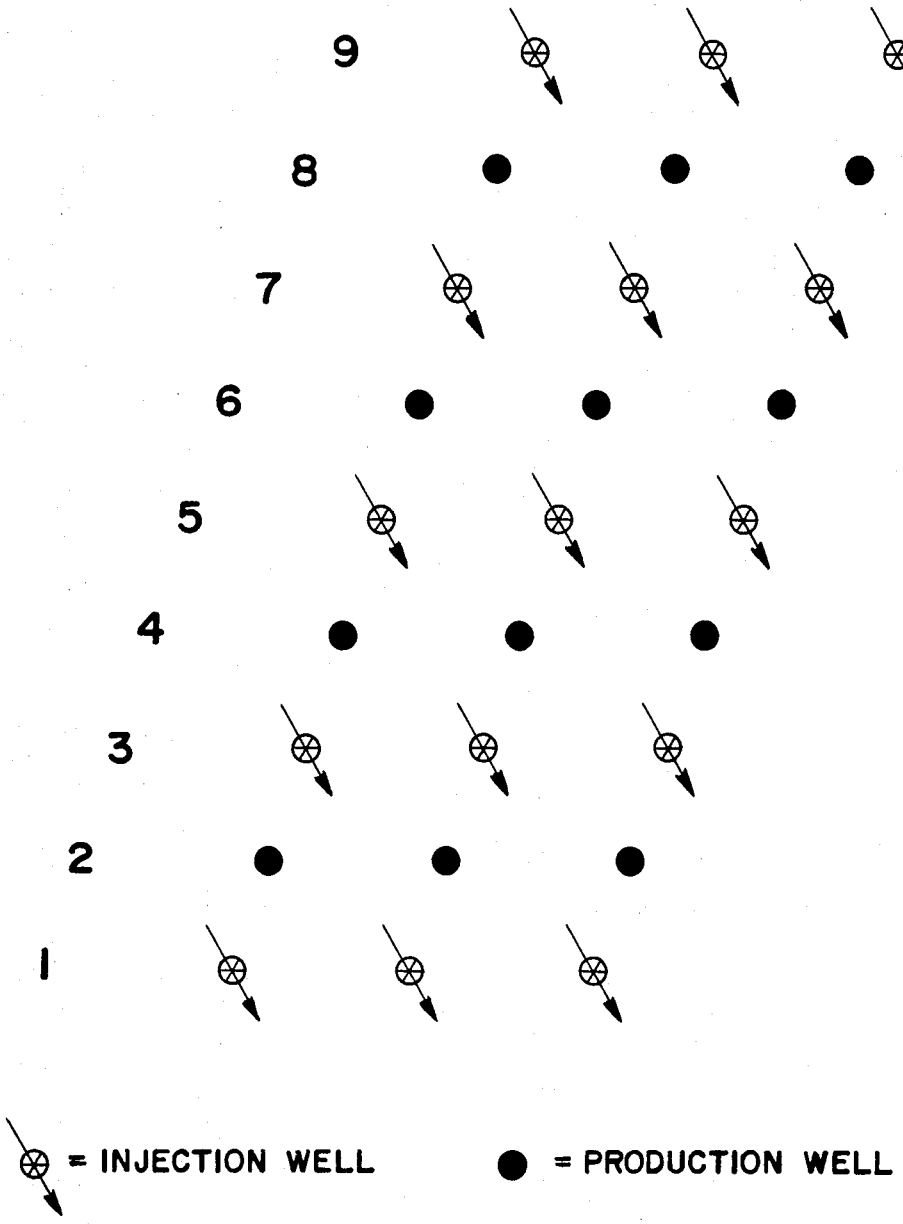
9
8
7
6
5
4
3
2
1
= INJECTION WELL
= PRODUCTION WELL

MISCIBLE DISPLACEMENT DRIVE FOR ENHANCED OIL RECOVERY IN LOW PRESSURE RESERVOIRS

FIELD OF THE INVENTION

This invention relates to enhanced oil recovery. More specifically, this invention relates to the use of a miscible displacement drive for enhancing oil recovery from a low pressure reservoir.

BACKGROUND OF THE INVENTION

Many oil field reservoirs contain hydrocarbons which are located in producing zones having insufficient pressure to drive the hydrocarbons to the surface. Only small amounts of hydrocarbons can be recovered without assistance. The literature is replete with methods of stimulating hydrocarbon recovery from oil field reservoirs suffering from such deficiencies. For example, a water drive injected at an injection well forces the hydrocarbons toward the production wells. However, this does not always greatly increase the recovery and is limited to areas where water is available. Chemical flooding increases the recovery of hydrocarbons but it is extremely expensive and suffers from the logistical problems of transportating the large amounts of chemicals to the remote oil fields. Natural gas has been proposed as a drive fluid, however, it is only miscible with the inplace hydrocarbons in high pressure fields. This limits its economic use to high pressure fields and areas where cheap natural gas is available.

Thus, it would be highly desirable to have a process which can use natural gas in low pressure hydrocarbon reservoirs. It would also be desirable to have a process which can be used in previously water flooded oil fields to further enhance the recovery of hydrocarbons. Furthermore, it would be desirable to have a process which maximizes the use of any upgraded hydrocarbon components derived from the natural gas.

SUMMARY OF THE INVENTION

I have invented a two-injection step miscible drive process which expands and extends the use of natural gas as a miscible drive fluid to enhance the hydrocarbon recovery from a low pressure reservoir. More specifically, the process involves the use of natural gas and its upgraded components as a miscible drive fluid to enhance the recovery of the hydrocarbons. The predominant component of natural gas, i.e., methane, is converted at an onsite methane conversion facility to higher hydrocarbons, including a $C_2$–$C_4$ cut. The conversion facility is operated so as to optimize production of the products which will include a $C_2$–$C_4$ cut. The miscibly optimized $C_2$–$C_4$ cut from the conversion plant is injected into the formation at a sufficient pressure to maintain the reservoir pressure or slightly enhance it but not at a sufficient pressure to fracture the formation. The injection is continued for a sufficient time to drive the recoverable hydrocarbons from the injection well toward the production well. This is usually from about 100 to 800 days. To minimize the cost of the recovery process, the miscible cut is followed by the injection of natural gas into the hydrocarbon formation. The natural gas is in turn miscible with the $C_2$–$C_4$ cut. The injection of the natural gas is continued until the initial injected miscible cut is recovered and reinjected at a different injection well to further the production of hydrocarbons from the whole field. Any unrecovered miscible fluids will have to be supplemented with fresh miscible fluids prior to reinjection. The supplementing of the recovered miscible fluids also provides an opportunity to change the composition to optimize the miscibility prior to reinjection if field conditions change.

The customizing of natural gas through upgrading to heavier $C_2$–$C_4$ hydrocarbons expands the use of natural gas which might otherwise go untapped in an adjacent or remote reservoir for lack of a commercial use. It should be noted that a natural gas miscible drive injection can proceed either after a field has become watered out, concurrent with a water drive, or initially as the main injection and displacement medium.

BRIEF DESCRIPTION OF THE DRAWING

The FIGURE illustrates an injection pattern suitable for carrying out the miscible displacement drive process of the invention.

DETAILED DESCRIPTION OF THE INVENTION

The invention will find its most economical use in the oil fields which are of low pressure, i.e., equal to or less than 1000 psi. The reservoir of hydrocarbons should be at least on the order of one million barrels and preferably located adjacent to have or have access to a natural gas field capable of producing at about one million SCFD. Oil fields meeting or exceeding these requirements are located in Indonesia and offshore in Northwest Australia. Hydrocarbon production is limited because the fields are low-pressure fields. Most preferably, the process can be most beneficially utilized where the hydrocarbon field is located over the gas field and the gas is produced, processed and injected into the field as a two-step miscible cut-natural gas drive. One oil and gas field meeting these requirements is found in Australia.

In reservoirs where the pressure generally exceeds 5000 psi, natural gas can be injected directly to obtain the benefits of miscible displacement. However, as indicated before, if the pressure drops, it is necessary to alter the composition of the natural gas to form a miscible drive fluid. This is accomplished by upgrading the methane component $C_1$, to a $C_2$–$C_4$ cut during appropriate upgrading process such as the synthesis gas process plus the Fischer Tropsch process. The process conditions are controlled so that an optimized cut to form the miscible drive fluid is obtained on site at the methane conversion plant. Of course, if it is cheaper, the $C_2$–$C_4$ cut, i.e., LPG, can be purchased already processed. It can also be transported to the oil field from another source.

The process is carried out by converting natural gas to ethane, propane and butane by a suitable process such as a synthesis gas process followed by a Fischer Tropsch process. The $C_2$–$C_4$ components in the hydrocarbon mixture are separated from the unconverted methane and the $C_5$+ components by conventional fractionation techniques. The ethane, propane and butane components, i.e., LPG mixture, are injected into a portion of the oil reservoir to displace the oil from the reservoir. The components are adjusted to maximize the miscibility of the LPG as drive fluid for the particular formation. At the conclusion of the displacement, the LPG mixture injected is stopped in that portion of the reservoir and started in a second portion of the reservoir. Natural gas which is miscible with the LPG is injected into the first portion of the reservoir to displace the LPG mixture toward the production well. The natural gas is continued until the efficiency of the LPG displacement declines. A suitable volume of miscible drive fluid is from about 0.05 to 0.5 hydrocarbon pore volumes and preferably from about 0.1 to about 0.2 hydrocarbon pore volumes. A suitable amount of natural gas is from about 0.5 to about 2.5 hydrocarbon pore volumes and preferably about 1.0 hydrocarbon pore volumes.

The LPG mixture recovered from the first portion of the reservoir by the subsequent natural gas injection is reused by injection into the second portion of the reservoir. This reinjection maximizes the economy of the process and minimizes the loss of the more valuable upgraded $C_2$–$C_4$ hydrocarbons. Since only 65% to 75% of the originally injected LPG mixture is recovered, a suitable make-up LPG mixture will have to be added to the recovered mixture prior to reinjection.

The injection and production wells can be arranged in any pattern. For example, a two-spot, a three-spot, a regular four-spot, a skewed four-spot, a five-spot, a seven-spot, an inverted seven-spot, a line drive configuration, and the like. Suitable patterns are described in The Reservoir Engineering Aspects of Waterflooding by Forrest F. Craig, Jr., Society of Petroleum Engineers of AIME, 1971, page 49, incorporated herein by reference. Preferably, the injection wells and production wells are operated in a regular line drive pattern wherein the odd-numbered rows in the line drive are injection wells and the even-numbered rows are production wells.

The process will be more clearly illustrated by reference to the following specific example. However, it is to be understood that the process is not intended to be limited to this specific example. Modifications which would be obvious to the ordinary skilled artisan are contemplated to be within the scope of the invention.

EXAMPLE

The following Example is illustrated by referring to the FIGURE.

A low-pressure field, i.e., on the order of 1000 psi, is divided into a ten-row line drive pattern in a standard line drive configuration. An optimized $C_2$–$C_4$ miscible drive fluid is injected into the first row (1). The composition of the miscible drive fluid is about 35.0 mole% ethane, 39.1 mole% propane, and 25.9 mole% butane. The ethane, propane and butane components are obtained from the upgrading of natural gas in an adjacent natural gas field located below the shallow oil field. The miscible fluid injection is continued until about 0.1 to 0.2 hydrocarbon pore volumes are injected. Thereafter, the miscible injection fluid is injected at a second set of injection wells (3), i.e. third row of wells, while the first injection row (1) has the miscible drive fluid displaced with about 1.0 hydrocarbon pore volumes of natural gas which is miscible with the $C_2$–$C_4$ cut. The miscible drive fluid recovered from the first production row, i.e., second row (2), is mixed with a fresh make-up miscible drive fluid and injected in the second set of injection wells, i.e., the third row (3). The process is carried on down the rows (4–9) of the line drive pattern. This process permits the economical recycling of the miscible drive fluid to enhance and maximize the recovery of hydrocarbons. Generally, the LPG injection in the third, fifth, and so on, rows will coincide with natural gas injection in the N−2 row. The injection period per pattern is about 500 days. The process is continued until the field is depleted of recoverable hydrocarbons.

An additional benefit of my invention is the possibility of using the higher components in the conversion process, i.e., $C_5$+ hydrocarbons, as transportation fuel.

What is claimed is:

1. A miscible drive process of recovering hydrocarbons from a low pressure hydrocarbon-bearing reservoir comprising:

injecting a $C_2$–$C_4$ mixture which forms a miscible drive fluid at reservoir conditions at a first injection well;

terminating the injection of said $C_2$–$C_4$ mixture at said first injection well and injecting natural gas at said first injection well while commencing the injection of the $C_2$–$C_4$ mixture at a second injection well separated from said first injection well by a production well;

recovering said $C_2$–$C_4$ mixture and hydrocarbons from said production well;

separating the $C_2$–$C_4$ mixture from the recovered hydrocarbons; and reinjecting the $C_2$–$C_4$ mixture at said second injection well.

2. The process according to claim 1 wherein the reservoir has a pressure of less than about 1000 psi and a temperature of less than about 300° F.

3. The process according to claim 2 wherein about 0.05 to 0.20 hydrocarbon pore volumes of the $C_2$–$C_4$ mixture is injected followed by about 0.5 to about 2.5 hydrocarbon pore volumes of natural gas.

4. The process according to claim 3 wherein the $C_2$–$C_4$ mixture recovered from the production well is injected at the odd rows of an in-line injection pattern while the hydrocarbons and recovered $C_2$–$C_4$ mixture are produced at the even rows of the line drive pattern.

5. The process according to claim 4 wherein said $C_2$–$C_4$ mixture is derived from the upgrading of natural gas obtained from a gas-bearing formation located at a greater depth than the hydrocarbon-bearing formation, said natural gas processed at the surface through the synthesis gas process followed by the Fischer-Tropsch process into the $C_2$–$C_4$ mixture.

6. A process of recovering hydrocarbons from a hydrocarbon-bearing formation penetrated by a line drive configuration pattern of wells, said configuration having alternating rows of injection and production wells comprising:

(a) injecting from about 0.1 to about 0.2 hydrocarbon pore volumes of a $C_2$–$C_4$ mixture at a first row of wells, wherein said $C_2$–$C_4$ mixture forms a miscible drive fluid at reservoir conditions and is derived from the surface upgrading of natural gas produced from a natural gas formation located at a depth greater than the depth of said hydrocarbon-bearing formation;

(b) terminating the injection of said $C_2$–$C_4$ mixture at said first row of wells while commencing the injection of about 0.1 to about 0.2 hydrocarbon pore volumes of said $C_2$–$C_4$ mixture at the thrid row of wells;

(c) injecting about 1.0 hydrocarbon pore volume of natural gas at said first row of wells to displace the formation hydrocarbons plus the $C_2$–$C_4$ mixture toward a row of production wells therebetween;

(d) reovering said $C_2$–$C_4$ mixture plus hydrocarbons at said row of production wells and separating out said $C_2$–$C_4$ mixture for reinjection at the next series of rows of injection wells to permit the recovery of hydrocarbons at the next series of rows of production wells; and wherein the hydrocarbon plus $C_2$–$C_4$ mixture is produced from the rows of production wells in the line drive pattern, and each sequential row of injection wells is first injected with from about 0.1 to about 0.2 hydrocarbon pore volume of said $C_2$–$C_4$ mixture followed by about 0.1 hydrocarbon pore volume of natural gas in which from about 65% to 75% of the injected pore volume of the $C_2$–$C_4$ mixture injected at the row of injection wells, after the first injection of the $C_2$–$C_4$ mixture of the first row of injections wells, is derived from the $C_2$–$C_4$ mixture produced at the row of production wells and reinjected at the next row of injection wells, and said process steps (a), (b), (c), and (d) continues sequentially along the pattern's rows of injection wells and rows of production wells.

* * * * *